US009238852B2

(12) United States Patent
Paliwal et al.

(10) Patent No.: US 9,238,852 B2
(45) Date of Patent: Jan. 19, 2016

(54) PROCESS FOR MAKING MOLYBDENUM OR MOLYBDENUM-CONTAINING STRIP

(71) Applicant: AMETEK, Inc., Berwyn, PA (US)

(72) Inventors: Muktesh Paliwal, Brookfield, CT (US); Ryan A. Smith, Cheshire, CT (US); Kerry B. Daley, Meriden, CT (US); Charles M. Italiano, Ossining, NY (US); Yakov Mindin, Brooklyn, NY (US)

(73) Assignee: Ametek, Inc., Berwyn, PA (US)

( * ) Notice: Subject to any disclaimer, the term of this patent is extended or adjusted under 35 U.S.C. 154(b) by 251 days.

(21) Appl. No.: 14/026,273

(22) Filed: Sep. 13, 2013

(65) Prior Publication Data

US 2015/0078950 A1 Mar. 19, 2015

(51) Int. Cl.

| | |
|---|---|
| ***C22C 1/04*** | (2006.01) |
| ***B22F 1/00*** | (2006.01) |
| ***B22F 3/02*** | (2006.01) |
| ***B22F 3/10*** | (2006.01) |
| ***B22F 3/24*** | (2006.01) |
| ***B22F 5/00*** | (2006.01) |
| ***C22C 27/04*** | (2006.01) |
| ***C22F 1/18*** | (2006.01) |
| ***B22F 3/18*** | (2006.01) |

(52) U.S. Cl.

CPC ..... *C22C 1/045* (2013.01); *B22F 1/0011* (2013.01); *B22F 1/0081* (2013.01); *B22F 3/02* (2013.01); *B22F 3/1017* (2013.01); *B22F 3/18* (2013.01); *B22F 3/24* (2013.01); *B22F 5/006* (2013.01); *C22C 27/04* (2013.01); *C22F 1/18* (2013.01); *B22F 2003/248* (2013.01)

(58) Field of Classification Search

CPC ..... B22F 3/18; B22F 3/24; C21D 8/0236; C22C 1/045; C22C 1/0491

USPC ..... 419/47

See application file for complete search history.

(56) References Cited

U.S. PATENT DOCUMENTS

| | | | | |
|---|---|---|---|---|
| 3,241,949 | A | | 3/1966 | Kunda et al. |
| 4,025,313 | A | | 5/1977 | Slaats |
| 4,373,970 | A | | 2/1983 | Scorey et al. |
| 5,288,561 | A | * | 2/1994 | Kibata et al. ..... 428/664 |
| 5,384,087 | A | | 1/1995 | Scorey |
| 5,493,153 | A | | 2/1996 | Arikawa et al. |
| 6,475,429 | B2 | | 11/2002 | Osada et al. |
| 6,589,368 | B1 | | 7/2003 | Takada et al. |
| 6,968,990 | B2 | | 11/2005 | Ott et al. |
| 7,311,873 | B2 | | 12/2007 | Moxson et al. |
| 2010/0183470 | A1 | | 7/2010 | Stone et al. |

FOREIGN PATENT DOCUMENTS

| | | | |
|---|---|---|---|
| CN | 101462167 | A | 6/2009 |
| CN | 102950287 | A | 3/2013 |
| GB | 928407 | A | 6/1963 |
| GB | 1 431 801 | A | 4/1976 |
| JP | 04-210459 | B2 | 7/1992 |
| JP | 5186802 | B2 | 7/1993 |
| JP | 8085840 | A | 4/1996 |
| WO | WO 2008/122075 | A1 | 10/2008 |

OTHER PUBLICATIONS

Lenz, XP002731978 LAMS-2612, pp. 1-41 (1961) (The ducument has been provided by the applicant on Dec. 17, 2014).*

Lenz, W.H., XP00231978 Lams-2612, pp. 1-41 (1961).

PCT/US2014/054205 International Search Report mailed Nov. 19, 2014.

China Tungsten Obnline (Xiamen) Manu. & Sales Corp., "Manufacture Process of Molybdenum Plate", URL: http://molybdenim-plate.net/manufacture-process-of-molybdenum-plate.html.

China Tungsten & Molybdenum, http://www.tungstenchina.com/product/Molybdenum-plate.html.

Oertel et al., Influence of Cross Rolling and Heat Treatment on Texture and Forming Properties of Molybdenum Sheets, 17$^{th}$ Plansee Seminar 2009, vol. 1, pp. RM 16/1-RM 16/10.

* cited by examiner

*Primary Examiner* — Weiping Zhu
(74) *Attorney, Agent, or Firm* — RatnerPrestia

(57) ABSTRACT

A method of making a molybdenum or molybdenum alloy metal strip is disclosed. The method includes roll compacting a molybdenum-based powder into a green strip. The method also includes sintering the green strip followed by a combination of warm rolling, annealing, and cold rolling steps to form the final metal strip which may be cut-to-length. The strip at the final thickness may also undergo an optional stress relief step.

24 Claims, 2 Drawing Sheets

PROCESS FOR MAKING MOLYBDENUM OR MOLYBDENUM-CONTAINING STRIP

FIELD OF THE INVENTION

The invention relates to a process for making pure molybdenum and molybdenum alloys in strip form.

BACKGROUND OF THE INVENTION

The conventional method of producing strip or sheets of molybdenum from a metal powder includes first making a slab. This is achieved by a compaction process, such as Cold-Isostatic Pressing, Vacuum Hot Pressing, or Die Pressing. The resulting thick slabs of molybdenum about 1.0" to 4.0" thick are then sintered at temperatures in the 1400° C. to 2300° C. range and then hot rolled at 1100° C. to 1400° C. range into plates about 0.4" to 0.6" thick. The plates are then annealed above the recrystallization temperature of the material and hot rolled again into sheets at slightly lower temperatures (1000° C. to 1250° C.) to a thickness close to 0.050". Multiple intermediate chemical etching and cleaning steps are carried out to remove embedded iron particles and surface oxides from the previous hot rolling operations. Subsequent rolling is carried out at warm working temperatures in the 200° C. to 500° C. range (lower temperatures are used as the material is progressively worked to thinner gauge). After approximately 50% reduction at the warm working temperatures, the material can be cold worked at room temperature with intermediate stress relief anneals.

Therefore, the conventional process for making the molybdenum-based thin strips from metal powders requires several hot rolling, chemical etching, and cleaning operations. Such an energy intensive process which also requires the use of harmful chemicals is costly, potentially hazardous, and environmentally unfriendly. Thus, there is a need for improved processes for manufacturing molybdenum-containing sheet.

SUMMARY OF THE INVENTION

It is an aspect of the present invention to develop a simplified process for making thin strips of pure molybdenum and molybdenum alloys, which includes the production of a green strip that is much thinner than those produced by conventional processes and in which several of the steps (hot rolling, chemical etching and cleaning operations) are eliminated.

Another aspect of the present invention is to provide a method of making a molybdenum or molybdenum alloy metal strip comprising roll compacting a powder having an alloying element content that is at least 98 wt % molybdenum into a green strip.

Yet another aspect of the present invention is to provide a method of making a molybdenum or molybdenum alloy metal strip by sintering a green strip made by roll compaction of a powder having an alloying element content that is at least 98 wt % molybdenum and a combination of warm rolling, annealing, and cold rolling of the sintered strip to form the final metal strip which may be cut-to-length.

DETAILED DESCRIPTION OF THE INVENTION

Figure 1:
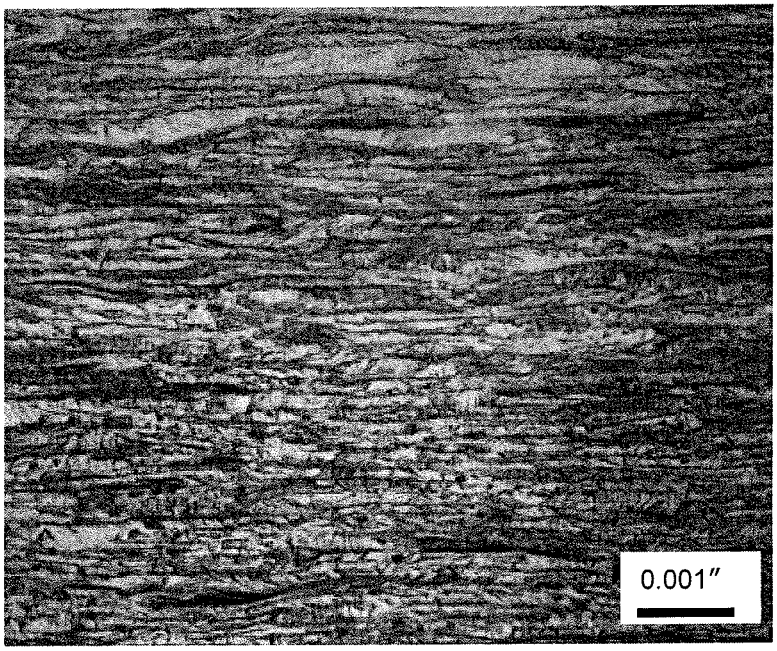
FIG. 1 is a magnified image of the microstructure of a molybdenum strip (0.015" thickness) made according to an embodiment of the present invention.
Figure 2:
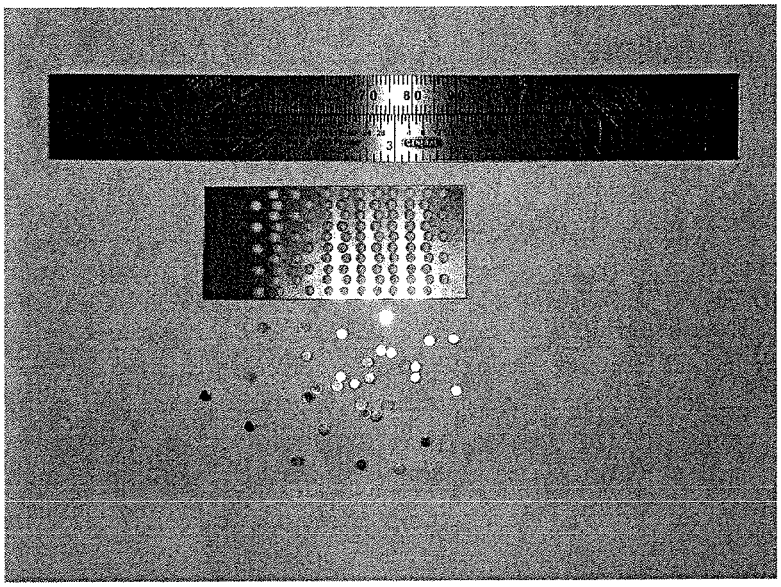
FIGS. 2 and 3 are images of stamped parts made from the molybdenum strip made according to an embodiment of the invention.
Figure 3:
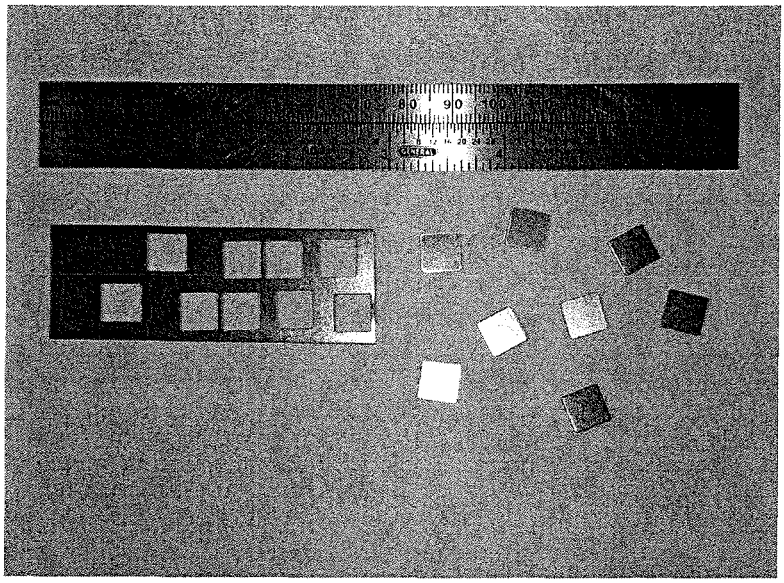
Figure 4:
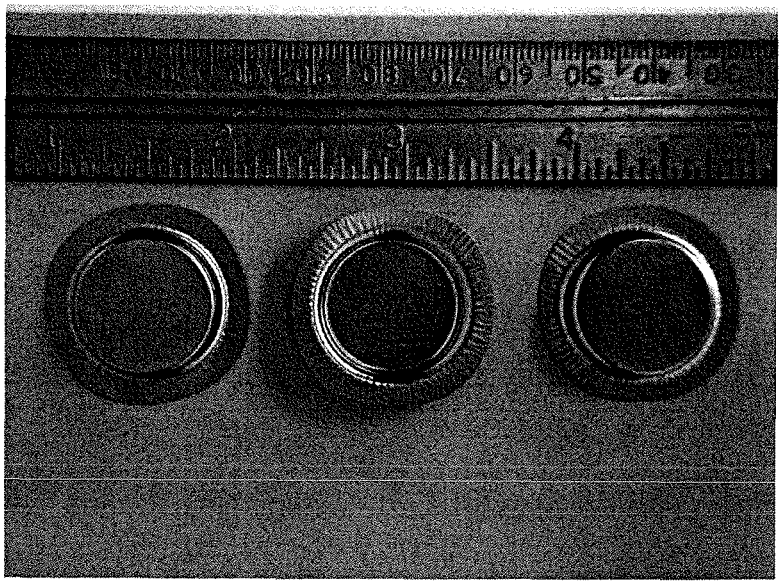
FIG. 4 is an image of drawn parts made from the molybdenum strip made according to an embodiment of the invention.

The present invention is a method of making a green strip of molybdenum or molybdenum-alloy comprising roll compaction. A "green" strip as used herein throughout the specification and the claims means a metal strip produced by roll compaction which has not yet been treated to remove oxygen and increase its strength, such as by sintering. Following roll compaction, the green strip is sintered under an atmosphere containing hydrogen to improve the strength and reduce the oxygen content of the strip. The sintered strip is then thermo-mechanically worked (warm rolling). As used herein throughout the specification and the claims, the term "warm rolling" means heating at least one of the strip and/or work rolls. According to embodiments of the present invention, the warm rolling temperatures are preferably in the 100° C. to 500° C. range. Intermediate re-crystallization or stress relief anneals are carried out as required between the warm working cycles. The densification of the strip occurs during the sintering, warm rolling, and the recrystallization anneals. The final density of the material, or a value close to the final density, is achieved after the warm rolling operations. The material is subsequently cold rolled. As used herein throughout the specification and the claims, the term "cold rolling" means mechanically working the strip without adding heat to the strip or work rolls until reaching the final desired finished thickness of the strip. According to embodiments of the present invention, cold rolling occurs at low temperatures, preferably less than 100° C. Material made using the process exhibits mechanical and thermo-physical properties that meet industry standards similar to conventionally processed material. As used herein throughout the specification and the claims, the term "strip" includes all materials commonly known in the industry as sheet, strip, or foil that is less than 0.050 inches in thickness.

In one embodiment of the present invention, molybdenum is provided in powder form. The powdered material may include pure molybdenum powder or a mixture of powders with the major constituent being molybdenum powder. In accordance with the process of the present invention, the desired alloy composition is obtained by mixing the constituent powders. When using powders of different constituents, the powders should be well mixed to insure homogeneity of the powder charge. In order to obtain the desired powder properties for roll compaction, these properties being apparent density, flow, and consolidation characteristics, along with the properties of the resulting green strip, the average particle size of the powders should be less than about 30 microns, preferably from about 1 micron to about 25 microns, more preferably from about 2 microns to about 10 microns. Other components known in the industry as additives or binders, which will preferably volatilize during subsequent processing, may be added to the powder charge to form a blend. Examples of these added components/additives would be dispersants, plasticizers, and sintering aids. Other known expedients may also be added for the purpose of altering the flow characteristics and the consolidation behavior of the powders in the blend. Suitable additives used for altering the characteristics of powders are well known in the art of powder metallurgy and include, for example, long chain fatty acids such as stearic acid, cellulose derivatives, organic colloids, salicylic acid, camphor, paraffin etc. Preferably, the additives used in the blend should be kept at amounts lower than 2 wt % of the blend. The powder materials and additives may be combined using any suitable technique known in the art. For example, a V-cone blender may be used.

Embodiments of the present invention may be used to produce strips of either pure molybdenum or of molybdenum alloys. The alloying elements are selected based on the desired properties of the final strip, such as the mechanical properties, e.g. yield strength, ultimate tensile strength, and % elongation, etc., or the thermo-physical properties, e.g. thermal conductivity and Coefficient of Thermal Expansion (CTE). Various standard molybdenum alloys and their respective compositions are known in the art. For example, see J. Shields, "Application of Molybdenum Metal and its Alloys", *IMOA Publication* (1995) on which Table 1 below is based. Common molybdenum alloys may be produced according to various embodiments of the present invention (values are provided in wt %):

TABLE 1

| Standard Molybdenum Alloys: | | | | | | | | | | | | |
|---|---|---|---|---|---|---|---|---|---|---|---|---|
| | Nominal Alloying Elements Additions | | | | | | | Hard Phase Additions | | | | Refractory Metal Additions W, Re, |
| Alloy | Hf | Ti | Zr | C | K | Si | Al | $La_2O_3$ | $ZrO_2$ | $Y_2O_3$ | $Ce_2O_3$ | Ta, Nb |
| HWM-25 | 1.2 | | | 0.05 | | | | | | | | |
| TZM | | 0.5 | 0.08 | 0.01-0.04 | | | | | | | | |
| TZC | | 1.2 | 0.3 | 0.1 | | | | | | | | |
| MHC | 1.2 | | | 0.05-0.12 | | | | | | | | |
| ZHM | 1.2 | | 0.4 | 0.12 | | | | | | | | |
| AKS-Doped | | | | | 0.015-0.020 | 0.03 | 0.01 | | | | | |
| Mo—$La_2O_3$ | | | | | | | | 0.03-0.30 | | | | |
| Mo—$ZrO_2$ | | | | | | | | | 1.5-2.0 | | | |
| Mo—$Y_2O_3$—$CeO_2$ | | | | | | | | | | 0.47 | 0.08 | |
| Mo—W Alloys | | | | | | | | | | | | Up to 50 wt % W |
| Mo—Re Alloys | | | | | | | | | | | | Up to 50 wt % Re |

When incorporating nominal alloying elements such as those provided in Table 1, the final molybdenum alloy strip made according to various embodiments of the present invention may include up to 2 wt % of the nominal alloying elements. Hard phase additions also generally comprise no more than 2 wt % of the final alloy strip. In addition to the oxides provided in Table 1, other examples of hard phase additions may include borides, nitrides, carbides, and silicides.

For alloys of molybdenum which include other refractory metals, tungsten and rhenium are commonly used; however, other refractory metals, such as tantalum and niobium may also be used, such that the final molybdenum alloy strip may contain as much as 50 wt % of the other refractory metals.

Upon adding any additives to obtain a powder blend, the material is then roll compacted to form a green strip having a desired thickness. The powder material is roll compacted by delivering the powder charge such that the powder cascades vertically between two horizontally opposed rolls with the powder fed into the roll nip in a uniform way.

The density and dimensions of the green strip is determined primarily by the physical properties of the powder and spacing provided between the horizontally opposed rolls as well as the forces applied by the rolls. The preferred thickness of the green strip is 0.050" to 0.200", more preferably 0.060" to 0.150". This provides a green strip which is significantly thinner than the green slab produced by, for example, CIP as mentioned above in the conventional process. Because the initial green strip is substantially thinner than the green slab produced by conventional processes, embodiments of the present invention may require less work, and as a result, less processing time, to reduce the thickness of the strip to a desired dimension upon finishing. It is preferred that the resulting green strip has a density that is 50% to 90% of theoretical density, more preferably 60% to 80% of theoretical density.

According to an embodiment of the present invention, a green strip may be provided by roll compacting as described above and followed by sintering. Sintering requires heating the green strip under a controlled atmosphere for a period of time. The sintering process reduces the oxygen content of the strip as well as provides inter-particle bonding and an increase in density, so that the strength of the resulting strip is significantly increased. It is preferred that sintering occur under a gaseous atmosphere comprising at least 10% hydrogen, more preferably 25% to 100% of hydrogen. Sintering may also occur under vacuum or partial pressure of an inert gas or more preferably under partial pressure of hydrogen. Sintering occurs at temperatures below the melting point of molybdenum, from 1000° C. to 2500° C., more preferably from 1100° C. to 2100° C., most preferably from 1200° C. to 1500° C. Though the higher temperatures may be used, low cost furnaces, which typically operate at temperatures around 1200° C., have been found to be sufficiently adequate for processes according to the present inventive method, thus allowing for a more economical process. The sintering process may last from 1 to 12 hours when higher temperatures are used and 12 to 80 hours at the lower sintering temperatures.

The present inventive method may include the optional step of cutting the strip to length before sintering. The length of the cut pieces may be dictated by the dimensions of the furnace used for sintering.

In order to further reduce the thickness of the sintered strip to a lighter gauge material, embodiments of the present invention include a process comprising a combination of warm rolling, annealing, and cold rolling the sintered strip to form the final molybdenum containing strip. The present invention provides a more economical process than conventional processing methods for producing molybdenum strip in that the present inventive method does not require the use of hot rolling. As described above, hot rolling occurs between 1100° C. and 1400° C., while warm rolling steps included in the method of the present invention may occur at approximately 500° C. or less. Lower temperatures require less thermal energy, and result in less oxygen pickup from the atmosphere and iron pickup from the rolls eliminating the need for etching and cleaning steps, thus providing a more economical process.

Prior to warm rolling, the sintered strip is brittle and prone to cracking if worked at room temperature. Increasing the strip temperature to the warm rolling temperatures improves ductility so that the strip can be successfully rolled without cracking.

In embodiments of the present inventive method, it is preferred that the warm rolling steps occurs at a temperature from 100° C. to 500° C., more preferably from a temperature from 200° C. to 400° C. It is also preferred that warm rolling occurs under conditions which minimize oxidation of the sintered strip. For example, warm rolling the sintered strip may occur under a reducing atmosphere or a gaseous atmosphere containing an inert gas. In another embodiment of the present invention, warm rolling may occur under an oxygen containing atmosphere, but at low temperatures which limits the oxidation of the sintered strip to acceptable levels. Additionally at the temperatures used in the warm rolling cycles there is minimal iron contamination of the strip from the rolls.

Warm rolling comprises working the material in order to reduce the strip's thickness. The strip may be passed one or more times through a warm rolling process. The total number of passes constituting one "warm rolling" cycle. According to an embodiment of the present invention, the strip thickness may be reduced 1% to 30% per pass, preferably 5% to 20% per pass, by warm rolling. The total reduction per warm rolling cycle is preferably 20% to 50%, preferably 30% to 40%. The degree of reduction per pass is dependent on temperature and therefore may be adjusted by increasing or decreasing the warm rolling temperature. Preferably, the reduction per pass is approximately 10% when the strip temperature is around 300° C. Higher temperatures can be used to increase the reduction per pass, however the strip needs to be protected (so as to not oxidize the strip surface) using an inert gas cover. The heating of the strip can be carried out under a reducing or inert gas protection. Similarly a cover gas can be used for the rolling operation to minimize oxidation of the strip.

Embodiments of the present inventive method may also include annealing, for example recrystallization annealing steps or stress relief annealing steps. Recrystallization anneal is carried out at a temperature above the recrystallization temperature of the material in order to reduce its strength and hardness and is accompanied by changes in the microstructure. Density improvements (increase) may also occur during the recrystallization anneals. According to various embodiments of the present invention, the recrystallization anneal occurs at a temperature from 1000° C. to 2000° C. For pure molybdenum or some alloys, the recrystallization anneal occurs preferably at a temperature from 1100° C. to 1500° C. The total time required for a recrystallization anneal may be shorter if higher temperatures are used. Preferably, the recrystallization anneal should last no more than 48 hours. Similar to sintering, annealing preferably occurs under a gaseous atmosphere comprising hydrogen and/or under partial pressure of hydrogen, or the recrystallization annealing may occur under vacuum or inert gas.

The stress relief anneal is carried out at a temperature below the recrystallization temperature of the material; it results in reducing the strength and hardness of the material (the relative changes are much smaller as compared to the recrystallization anneal) without significant changes in the microstructure. Residual stresses in the material are removed as a result of these anneals. Stress relief annealing preferably occurs at a temperature from 800° C. to 1200° C. Similar to sintering, the stress relief anneal preferably occurs under a gaseous atmosphere comprising hydrogen and/or under partial pressure of hydrogen, or the stress relief anneal may occur under vacuum or inert gas.

Following warm rolling, the embodiments of the present inventive method may include cold rolling. Cold rolling, similar to warm rolling, comprises a process for reducing the strip's thickness. The strip may be passed through a cold rolling process multiple times. The total number of passes constituting one "cold rolling" cycle. Intermediate stress relief anneals may be used between cold rolling cycles. Cold rolling included in a method according to the present invention occurs at a temperature below the warm rolling temperature, preferably at a temperature at or below 100° C., and carried out to the desired finished thickness of the strip.

Embodiments of the present invention may include a plurality of warm rolling cycles which occur at lower temperatures with an annealing step (recrystallization anneal or stress relief anneal) occurring between each warm rolling cycle. Lower rolling temperatures which achieve a lower reduction in thickness per pass would require a higher number of passes per cycle or total cycles to achieve a desired thickness than would be needed for warm rolling at a higher temperature. For example, the sintered strip may be reduced first by warm rolling followed by a recrystallization anneal and further reduced by warm rolling the strip again. Thereafter, it may be reduced to a desired final thickness by cold rolling with intermediate stress relief anneals. Again, each warm rolling and cold rolling cycle may include multiple passes. Preferably, the strip following the final warm rolling cycle, which occurs at 400° C. and lower, has a thickness that is 60% or less, more preferably 50% or less of the thickness of the sintered strip. Following the final cold rolling cycle, the molybdenum containing strip has a thickness that is preferably 35% or less of the thickness of the original green strip, i.e. reduction of a green strip according to an embodiment of the present invention may require about 65% reduction to reach the target thickness. Conventional processes which use a thick green slab as the starting material may require a 95% or greater reduction to obtain a sheet of similar thickness.

Following cold rolling, the strip upon reaching that final target thickness may be subjected to an optional final stress relief anneal.

EXAMPLES

In order that the invention may be more fully understood the following Examples are provided by way of illustration only.

Example I

Molybdenum metal powder was obtained which had an oxygen content of 700 ppm and a carbon content of less than 30 ppm. Approximately 2 kg of the molybdenum powder was mixed with a cellulose binder and blended for 15 minutes. The blended powder was roll compacted to produce green strip having a thickness of 0.090".

The strip samples were then sintered in a laboratory furnace under a gaseous flow of hydrogen having a dew point of −50° F. The sintering cycle comprised heating the samples to 1200° C. and a hold time of 48 hours. The oxygen content of the sintered strips was 32 ppm.

Following sintering, the samples were warm rolled at 300° C. After three passes, the warm rolling cycle reduced the thickness of the samples to 0.060" (a 33.3% reduction in thickness).

The samples were again placed in the furnace for a recrystallization anneal. Similar to sintering, the samples were annealed under a gaseous flow of hydrogen. The annealing cycle comprised heating the samples to 1200° C. The hold time at temperature was 24 hours.

The samples were warm rolled again in a similar fashion, i.e. at 300° C. and the cycle comprising three passes. The thickness of the samples was reduced from 0.060" to 0.033" resulting in a 45% reduction in thickness.

To further reduce the thickness of the strip samples, the samples were cold rolled under ambient conditions by passing the samples through a cold rolling mill multiple times. The thickness of the samples was reduced from 0.033" to 0.015" resulting in about 54.5% reduction in thickness. The reduction in thickness based on the starting green strip thickness of 0.090" was 83.3%. A stress relief anneal was applied as a finishing step by heating the samples in a furnace under hydrogen flow for 30 minutes at 875° C.

The final strip samples had an $O_2$ content of 37 ppm and an $N_2$ content of 9 ppm; the material was tested for thermo physical properties relevant for use as a heat sink material. It exhibited a thermal conductivity of 139 W/mK and an average coefficient of thermal expansion (CTE) in the 100° C. to 1000° C. range of 5.71E-06/K. The CTE was approximately equal in the longitudinal and transverse directions.

Example II

Molybdenum metal powder obtained from a second source was roll compacted and processed into a finished strip using a procedure similar to Example I. The finished strip after the stress relief operation had an $O_2$ content of 32 ppm and an $N_2$ content of 5 ppm. Tensile test results for the samples are provided below in Table II:

TABLE II

| | Longitudinal | Transverse |
|---|---|---|
| Yield Strength (ksi) | 109.0 | 117.9 |
| UTS (ksi) | 126.5 | 136.6 |
| Elongation (%) | 15.0 | 9.9 |

The economical and improved powder metallurgy process for making strips of molybdenum based materials provided by the present inventive method produces strip having desirable physical characteristics (thickness, surface roughness, density, etc.), tensile properties (yield strength, ultimate tensile strength and elongation), and thermal properties (CTE and thermal conductivity) equivalent to molybdenum strip manufactured by conventional methods. The present inventive method provides a process which uses relatively low temperatures for warm rolling operations compared to standard hot rolling temperatures in conventional processes for producing molybdenum containing strip. The low temperatures provide the benefit of reduced iron contamination from the rollers and reduced generation of oxides; thereby, minimizing or eliminating the need for chemical etching operations to clean the surface of the molybdenum containing strip.

While preferred embodiments of the invention have been shown and described herein, it will be understood that such embodiments are provided by way of example only. Numerous variations, changes, and substitutions will occur to those skilled in the art without departing from the spirit of the invention. Accordingly, it is intended that the appended claims cover all such variations as fall within the spirit and scope of the invention.

What is claimed:

1. A method of making a molybdenum-containing strip comprising roll compacting a powder into a green strip, the powder comprising at least 98 wt % molybdenum, sintering the green strip to produce a sintered strip, and thermo-mechanically working the sintered strip to produce a processed strip, wherein thermo-mechanically working the sintered strip consists of one or more warm rolling steps at temperatures no greater than 500° C.

2. The method of claim 1, wherein the powder has an average particle size of 1 to 25 μm.

3. The method of claim 1, wherein the powder is 100 wt % molybdenum.

4. The method of claim 1, wherein the powder further comprises up to 2 wt % of at least one alloying element selected from the group consisting of Hf, Ti, Zr, C, K, Si and Al.

5. The method of claim 1, wherein the powder further comprises up to 2 wt % of at least one hard phase.

6. The method of claim 1 further comprising mixing the powder with at least one additive to form a blend and wherein prior to roll compacting, the blend comprises up to 2 wt % of the at least one additive.

7. The method of claim 1, wherein the green strip has a thickness of 0.050" to 0.200".

8. The method of claim 1, wherein the green strip has a density of 50% to 90% of theoretical density.

9. The method of claim 1, wherein sintering occurs at a temperature from 1000° C. to 2500° C.

10. The method of claim 1, wherein sintering occurs under vacuum or partial pressure of inert or reducing gases.

11. The method of claim 1, wherein the processed strip is not subjected to an etching or a cleaning step to remove oxygen or impurity pickup from rolling mill rolls.

12. The method of claim 1, wherein at least one annealing step occurs between two warm rolling steps.

13. The method of claim 12, wherein annealing includes a recrystallization anneal and occurs at a temperature from 1000° C. to 2000° C.

14. The method of claim 12, wherein annealing includes a stress relief anneal and occurs at a temperature from 800° C. to 1200° C.

15. The method of claim 12, further comprising performing a stress relief anneal on the processed strip as a finishing step.

16. The method of claim 15, wherein the stress relief anneal occurs at a temperature from 800° C. to 1200° C.

17. The method of claim 1 further comprising performing a stress relief anneal on the processed strip as a finishing step.

18. The method of claim 1, wherein warm rolling occurs at a temperature from 100° C. to 500° C.

19. The method of claim 1, wherein warm rolling occurs under a reducing atmosphere or under an inert gas.

20. The method of claim 1, wherein warm rolling occurs at 200 to 400° C. and each warm rolling step comprises one or more passes causing a thickness reduction of 1 to 30% per pass.

21. The method of claim 1 further comprising the step of cold rolling the processed strip after thermo-mechanically working the processed strip.

22. The method of claim 21, wherein following warm rolling and prior to cold rolling, the processed strip has a thickness at least 50% of the thickness of the sintered strip.

23. The method of claim 21, wherein the processed strip after cold rolling has a thickness that is 35% or less of the thickness of the green strip.

24. A method of making a molybdenum-containing strip comprising:

roll compacting a powder into a green strip, the powder comprising a combination of molybdenum and at least one refractory metal selected from the group consisting of W, Re, Ta, and Nb, and the powder having a ratio of molybdenum to refractory metal of at least 1:1, sintering the green strip to produce a sintered strip, and thermo-mechanically working the sintered strip to produce a processed strip, wherein thermo-mechanically working the sintered strip consists of warm-rolling at temperatures no greater than 500° C.

* * * * *